US006055713A

United States Patent [19]

Genei

[11] Patent Number: 6,055,713

[45] Date of Patent: May 2, 2000

[54] CONTAINER AND METHOD OF FORMING

[75] Inventor: Martin R. Genei, Saginaw, Mich.

[73] Assignee: Genei Industries Incorporated, Saginaw, Mich.

[21] Appl. No.: 09/023,094

[22] Filed: Feb. 17, 1998

[51] Int. Cl.[7] ..... B23P 11/00; B65D 6/08; B65D 6/28

[52] U.S. Cl. ..... 29/401.1; 29/525.02; 29/525.01; 220/4.21; 220/678; 220/679

[58] Field of Search ..... 29/525.01, 525.02; 220/4.21, 678, 679; 156/92, 256, 258, 263, 292, 304.2, 305; 428/223

[56] References Cited

U.S. PATENT DOCUMENTS

| | | | |
|---|---|---|---|
| 3,669,338 | 6/1972 | Cornell et al. | 229/23 BT |
| 3,744,659 | 7/1973 | Koehler | 217/7 |
| 4,440,307 | 4/1984 | Bartels et al. | 220/4 B |
| 5,649,638 | 7/1997 | Roy et al. | 220/4.26 |
| 5,678,716 | 10/1997 | Umiker | 220/4.26 |

*Primary Examiner*—David P. Bryant
*Assistant Examiner*—Essama Omgba
*Attorney, Agent, or Firm*—Reising, Ethington, Barnes, Kisselle, Learman & McCulloch, P.C.

[57] ABSTRACT

A unitary, four-side container having a bottom is formed from two smaller container units each of which originally has a bottom and four upstanding sides. A corresponding side of each of the smaller units is removed from the level of the associated bottom to form two half units and the two half units then are positioned adjacent one another so that their bottoms and corresponding side walls confront and abut one another. Anchor bolts secure the two half units to one another along and beneath their bottoms and along their abutting side walls. An uncured, curable adhesive polymer is applied to the junctures of the bottoms and side walls and cured to provide a bond between the bottoms and side walls of the half units and between the anchor bolts and the half units.

3 Claims, 5 Drawing Sheets

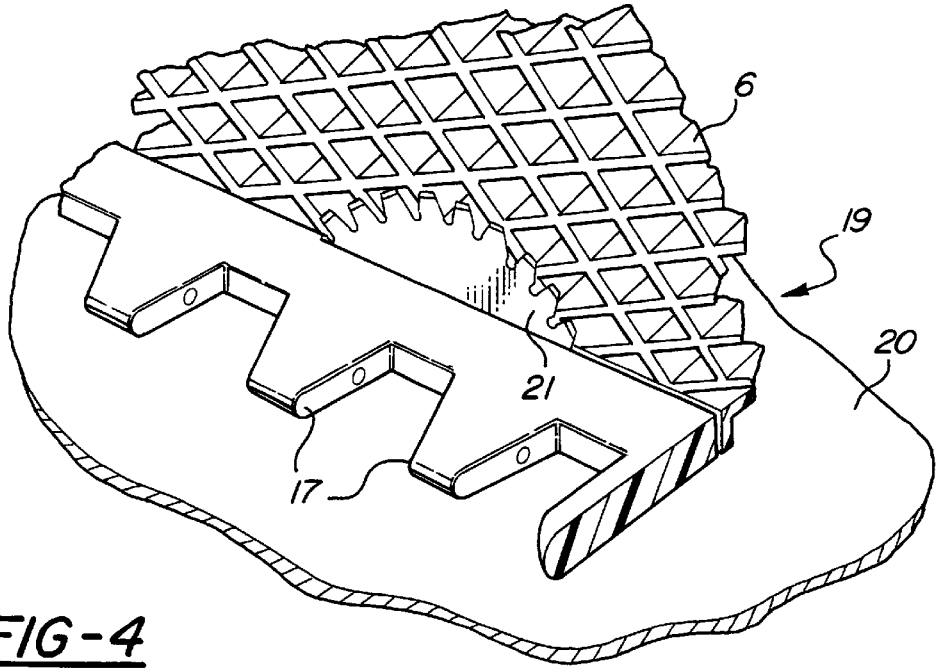
FIG-4
FIG-5
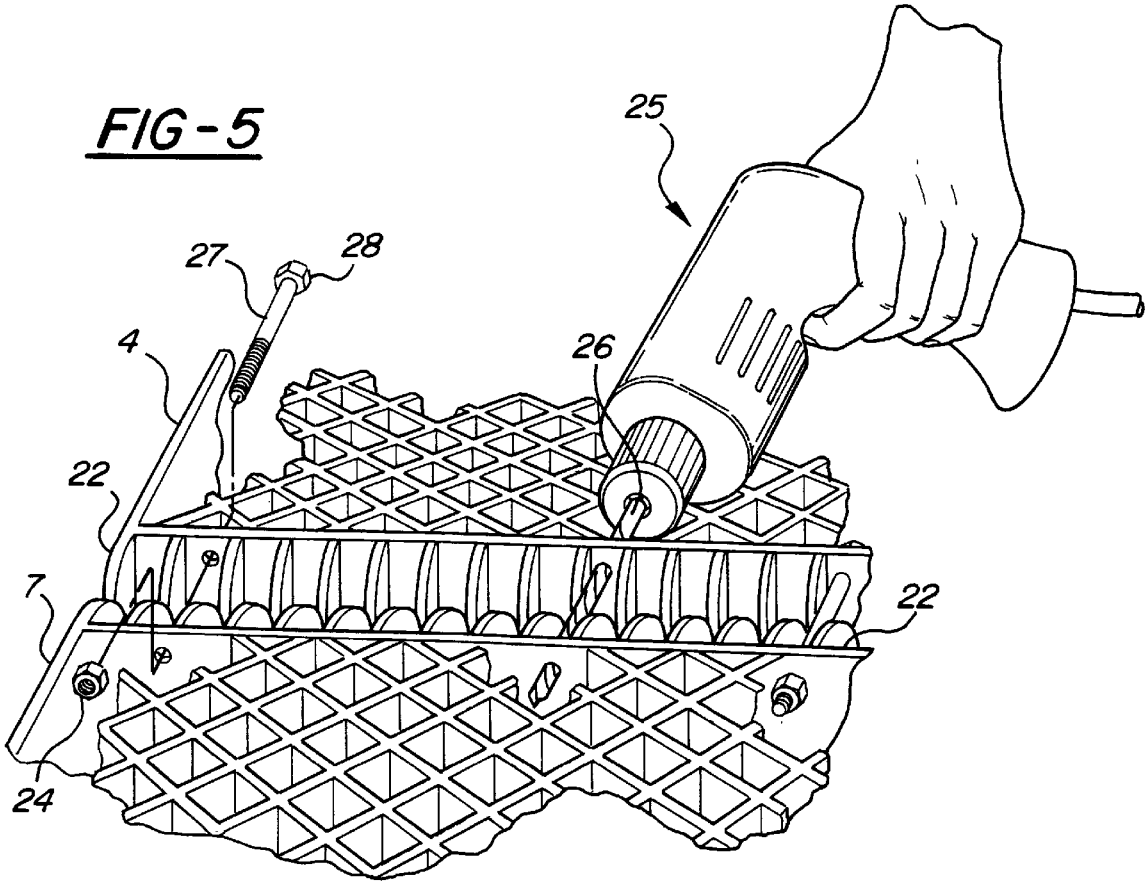

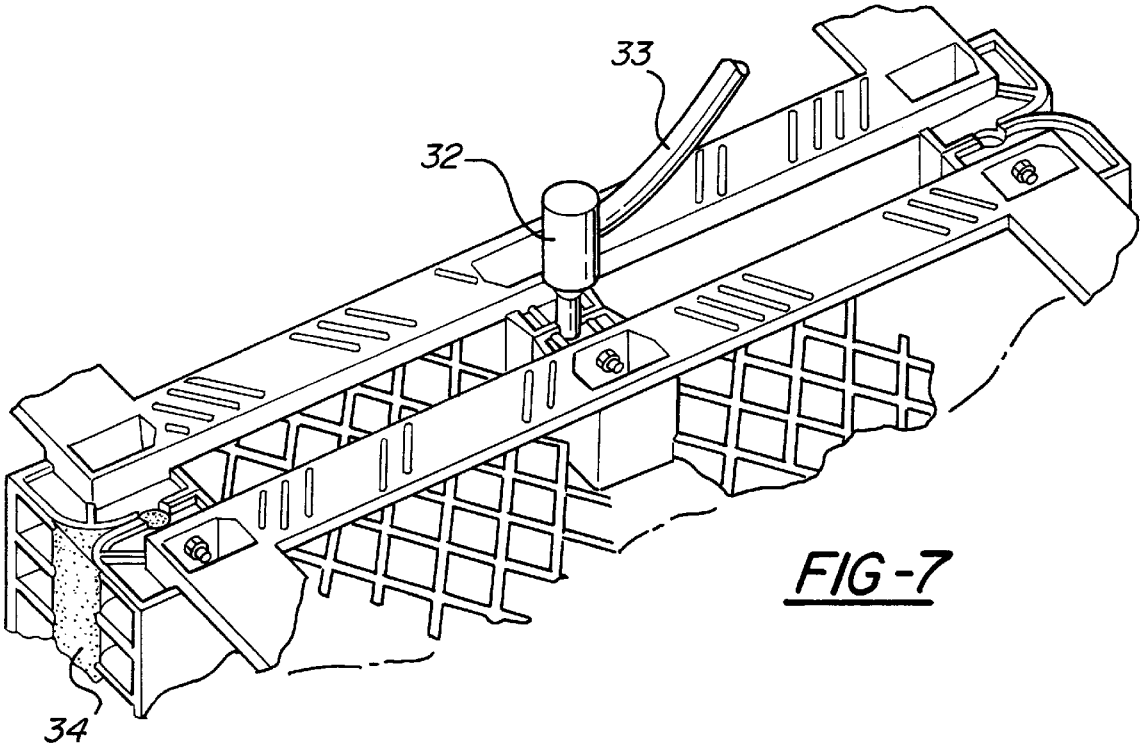
FIG-7
FIG-8
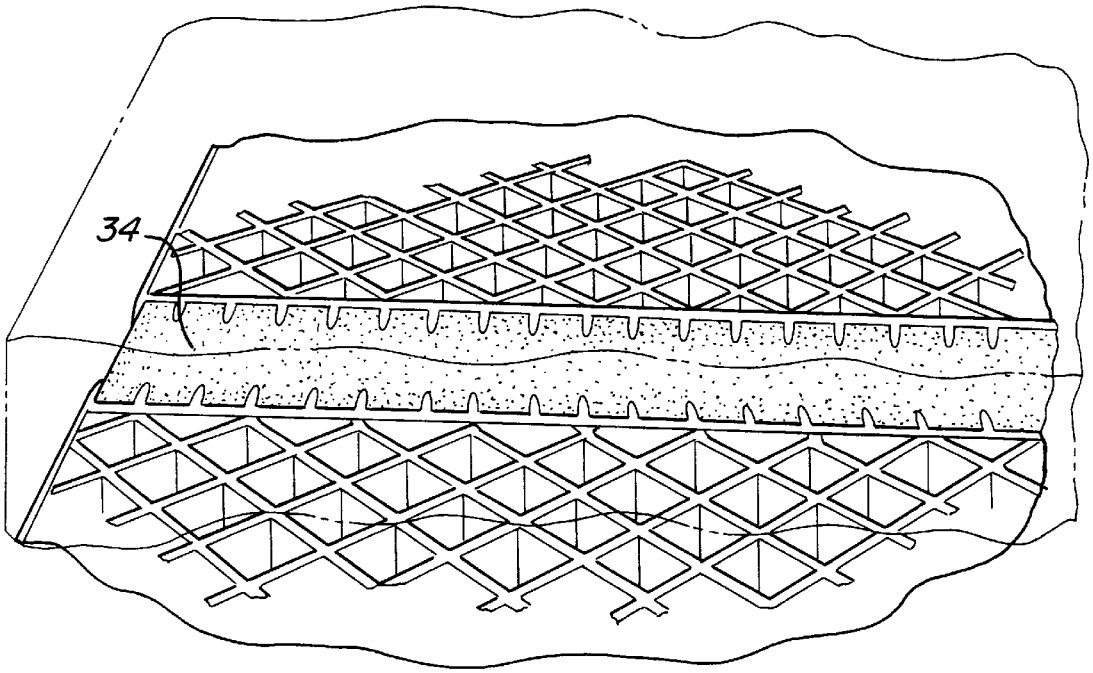

CONTAINER AND METHOD OF FORMING

This invention relates to reusable containers formed of plastic materials and designed to take the place of metal or wood containers or receptacles that are used to store and transport goods from one place to another.

BACKGROUND OF THE INVENTION

The use of plastic containers as replacements for metal and wood bins is fairly common and has many advantages thereover. For example, the plastic containers are not subject to rusting, are more durable than wood, and in many instances may be lighter in weight without sacrificing strength.

One of the difficulties with the use of plastic containers is that such containers must be formed in molding operations which require the use of molds that are expensive to construct and quite heavy in those instances in which the containers to be produced by such molds are fairly large. It is not uncommon that articles to be placed in containers are too large to be accommodated completely within the confines of a molded container. This is an undesirable practice because it then exposes the article to potential damage. Simply providing larger molds to form larger containers to accommodate larger articles is rather uneconomical in view of the marked increase in the cost of and the difficulty in handling molds, as has been referred to earlier.

A principal object of the invention is to provide a way of modifying conventional size containers in such manner as to produce economically a single, greatly enlarged container and without the necessity of increasing the size of molds that are used in the production of the conventional, smaller size containers.

SUMMARY OF THE INVENTION

There are several manufacturers of plastic, reusable containers which are of more or less standard exterior dimensions such as 45–48 inches in length, 40–48 inches in width, and 17–34 inches in height. A container that is substantially double the width or length may be formed according to the invention by cutting away corresponding walls of each of two conventional containers following which the containers are moved to positions in which two of the parallel remaining walls of each of the containers and their bottoms confront one another whereupon anchor bolts can be secured to each of the units and span the joint therebetween, thereby forming a single container which has twice the length and width dimensions of each of the two units from which the expanded container is formed. The expanded container can be rigidified by introducing a curable polymer adhesive between the confronting edges of the walls and bottoms of the two units followed by curing of the polymer to form an adhesive bond not only between the structural parts of the assembled container halves, but also between the structural parts and the anchor bolts themselves.

An extended or enlarged container formed in accordance with the invention has a rigidity at least as great as that of a container of the same size and formed in a single large mold, but can be produced at a much lower cost than would be required if the desired size container must be produced by means of a correspondingly enlarged mold. Further, the factory at which the extended container is produced according to the invention does not require the purchase and use of material handling equipment that is sufficiently large and strong to enable the handling of large molds such as those that would be required if the extended size container were to be molded.

THE DRAWINGS

The invention is illustrated in the accompanying drawings wherein:

FIG. 4 is a fragmentary, isometric view illustrating the cutting of one of the end walls of the conventional size unit;

FIG. 5 is a fragmentary, isometric view illustrating the coupling of two modified, conventional units together by means of anchor bolts;

FIG. 7 is an isometric view, similar to FIG. 6, but on a smaller scale, illustrating one step in the process of bonding two container halves together; and FIG. 8 is a view similar to FIG. 5 and illustrating the bonding material in place.

THE PREFERRED EMBODIMENT

Figure 1:
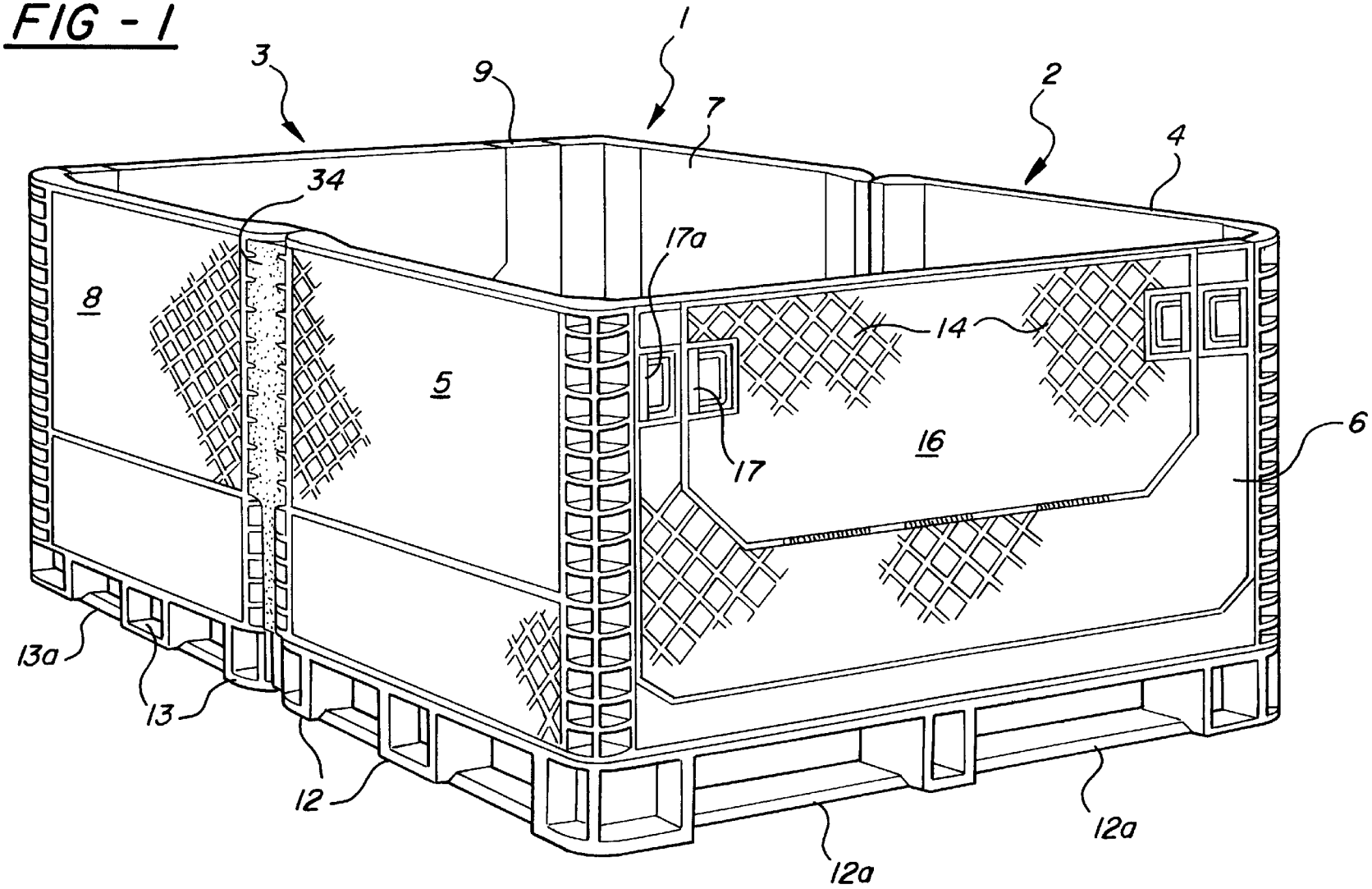
FIG. 1 is an isometric view of an extended container formed from two smaller containers.

An extended container constructed in accordance with the invention is designated generally by the reference character 1 and is composed of two three-sided units 2 and 3 which originally had four upstanding walls and a bottom, but which have been modified to have only three upstanding walls and a bottom. The upstanding walls of the unit 2 comprise spaced, parallel side walls 4 and 5 and an end wall 6 that spans corresponding ends of the side walls 4 and 5. The unit 3 has similar side walls 7 and 8 and a similar end wall 9. The unit 2 has a horizontal bottom wall 10 and the unit 3 has a bottom wall 11, each of the two bottom walls being at the same level and having a flat upper surface. Secured to and projecting downwardly from the bottom wall 10 is a plurality of spaced apart supporting feet 12 and corresponding supporting feet 13 project downwardly from the bottom wall 11. The supporting feet are spaced from one another a distance sufficient to enable the tines of a forklift or other truck to pass beneath the bottom walls and in the spaces between adjacent supporting feet, as is customary. The adjacent feet are spanned by stringers 12*a* and 13*a*, respectively.

As is best shown in FIG. 1, the end wall 6 of the unit 2 has a honeycomb appearance formed by reinforcing ribs 14. The end wall 6 is composed of two parts 15 and 16, the part 15 being notched for the accommodation of the part 16. The part 16 has hinge leaves 17 at its lower end to enable the part 16 to pivot about its lower edge, in a conventional manner, so as to enable the part 16 to swing either inwardly or outwardly. Latches 17 are operable manually to enable the part 16 to be latched and unlatched with respect to the wall part 6. The wall part 6 also has hinge leaves like the leaves 17 and may be swingable about its lower edge either inwardly or outwardly. Additional latches 17*a* are provided to enable the end wall 6 to be latched in an upright position or swung to a lowered position.

The end wall 9 corresponds in all respects to the end wall 6 and, accordingly, need not be shown or described in detail.

Figure 3:
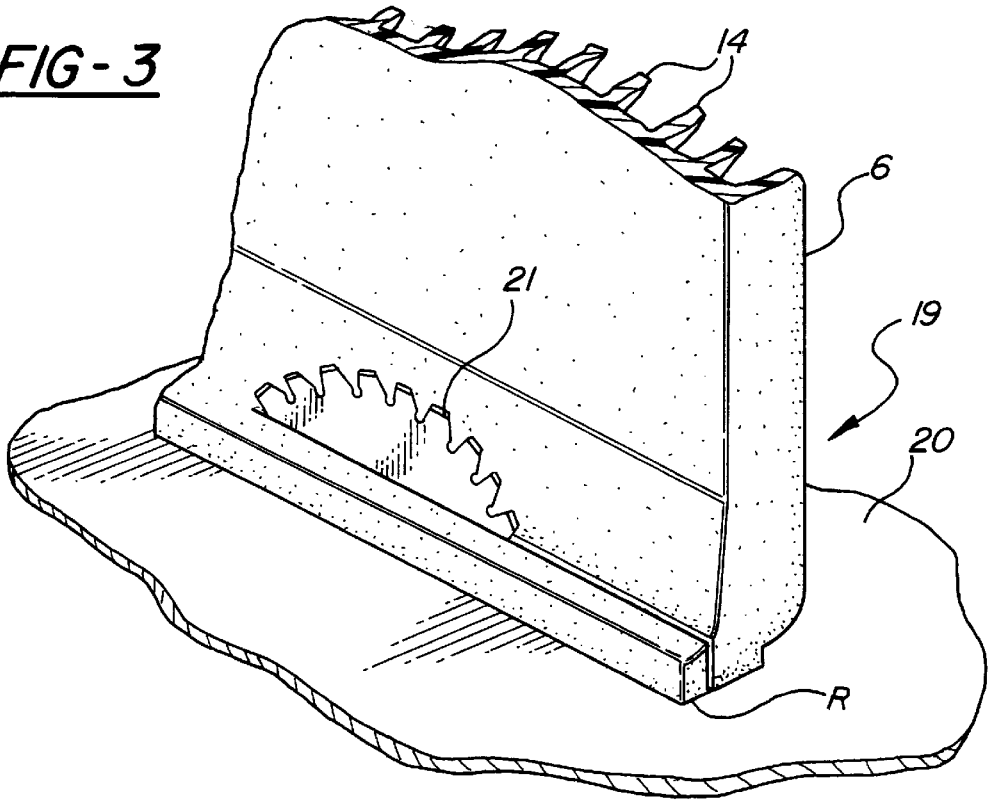
FIG. 3 is an isometric view illustrating the cutting of a part of one of the conventional units.
Figure 6:
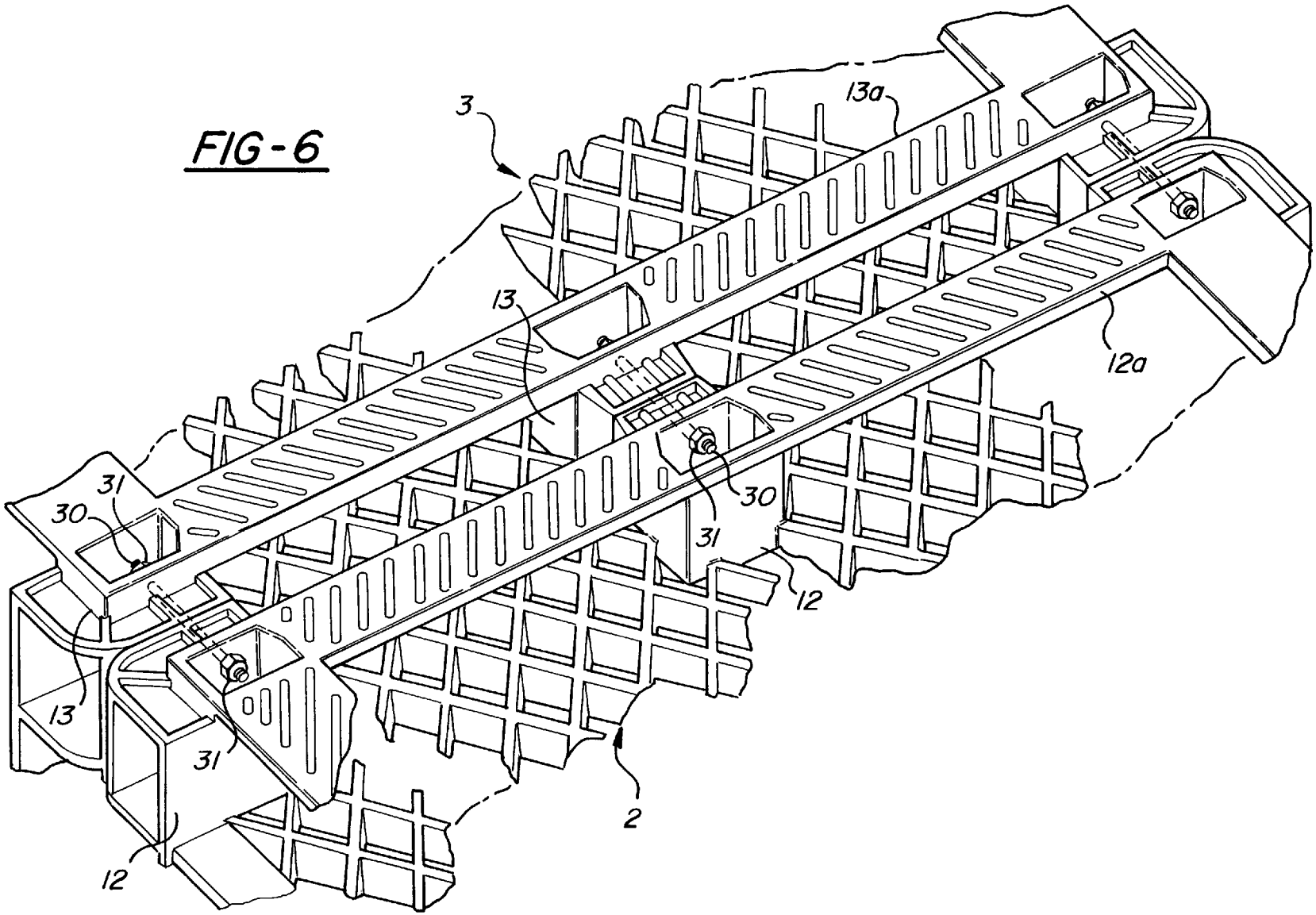
FIG. 6 is a fragmentary, isometric view illustrating the exterior, bottom of two containers that have been bolted to one another.

Originally, the unit 2 had a second wall corresponding to and spaced from and parallel to the wall 6, and the unit 3 had an end wall corresponding to and spaced from and parallel to the wall 9. These walls, however, have been removed from the respective units by means of a tablesaw 19, for example, having a table surface 20 through which a sawblade 21 extends and which may be used to cut the end walls from the side walls as is indicated in FIGS. 3 and 4. The sawing forms smooth surfaces at the inside edges of the members from which the sawed walls are removed.

At the juncture of the walls 6 and 9 with their respective side walls is a ladderlike pillar 22 which provides rigidification, as will be explained, when the units 2 and 3 are joined together.

Figure 2:
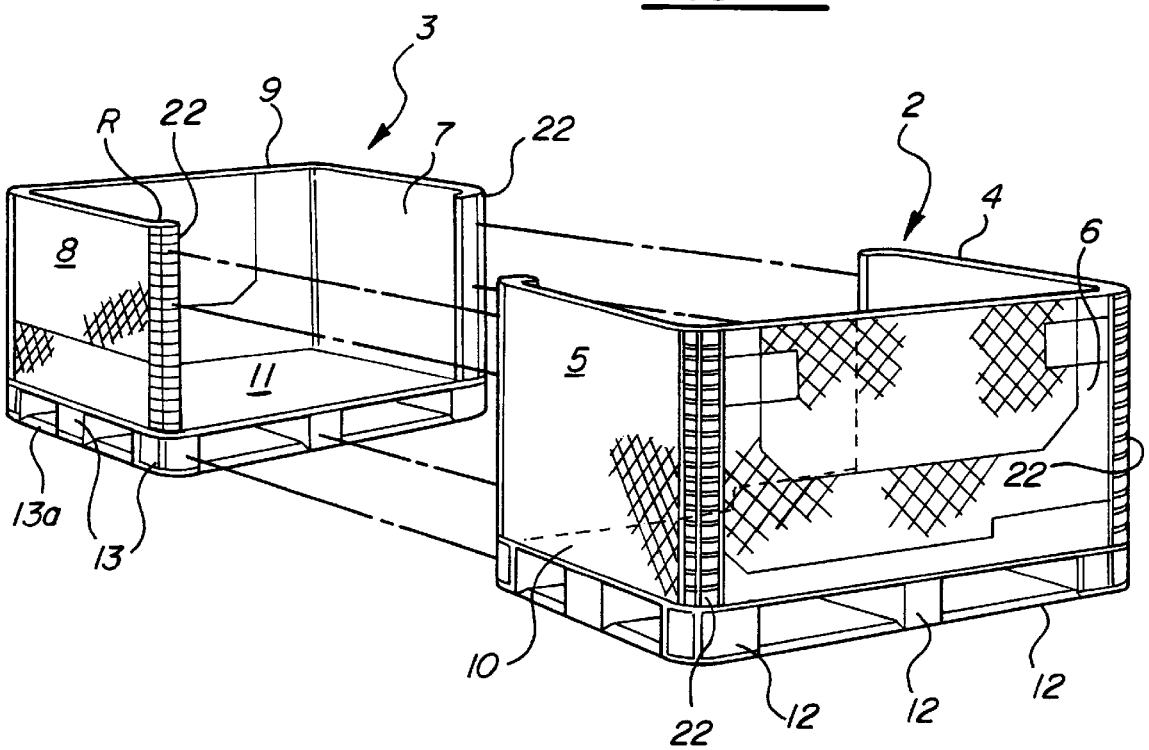
FIG. 2 is an isometric view of two conventional size units that have been modified preparatory to being joined to one another.

Following trimming of the end walls that are opposite the walls 6 and 9 the two trimmed units 2 and 3 are placed in the position shown in FIG. 2 in which the walls 4 and 5 of the unit 2 confront the walls 7 and 8 of the unit 3. The units 2 and 3 then may be moved toward one another so that the pillars 22 confront and abut each other and the two bottom walls 10 and 11 form a coplanar base for the finished container. See FIGS. 2 and 5. In these positions a drill 25 having a bit 26 may be used to form openings in the adjacent pillars 22 for the accommodation of anchor bolts 27 having a head 28 at one end and being threaded at the other for the accommodation of a nut 29. The bolts 27 may be spaced longitudinally of the pillars and tightened so as to maintain the confronting sides 4, 7 and 5, 8 in snug abutment.

Following securing of the pillars to one another the joined units 2 and 3 may be overturned and the drill 25 used to form openings in the confronting walls of the supporting feet 13 for the accommodation of additional anchor bolts 30 threaded at both ends for the accommodation of nuts 31. These bolts 30 secure the units 2 and 3 to one another from side to side and below the bottoms of such units.

Following securing of the two units 2 and 3 to one another by the anchor bolts 30, a nozzle 32 coupled at one end to a delivery tube 33 having its other end coupled to a source of flowable, curable adhesive polymer may be used to deliver the adhesive polymer in situ to the adjacent pillars 22 and to the cavities formed by the supporting feet 13 where the anchor bolts 30 are located. The adhesive is one that is compatible with and bondable to the plastic material from which the container parts are made and also is compatible with and bondable to the metal from which the anchor bolts are made. If the container units 2 and 3 are formed of high density polyethylene, as is common, and if the anchor bolts are formed of steel, as also is common, the adhesive polymer may be any one of a number of glass filled epoxies, but other adhesive polymers also are usable provided they are relatively quickly curable and form a strong bond between the two parts of the assembled container and the anchor bolts. When the adhesive polymer cures, it will form a smooth surface body between the units 2 and 3 so as to give the completed, enlarged container 1 a finished appearance. The polymer also will be interleaved with the parts forming the ladderlike pillars, thereby greatly increasing the surface adhesion of the polymer and the edges of the container halves and rigidifying the joint therebetween.

If the two units 2 and 3 originally were 45 inches in length, the finished container 1 will be 90 inches in length. Thus, it is possible to make an enlarged container twice the length of its original component parts, but without having to construct a mold capable of producing containers 90 inches in length.

The coupling of the two half units 2 and 3 to one another by the combination of an adhesive polymer and anchor bolts forms an exceptionally strong joint between the half units. Containers constructed in accordance with the invention have been subjected to rigorous testing, including extreme vibration, repeated torsion forces, and repetitive bulkhead slamming or compression. Such extended-size containers have proven to be every bit as strong as the components from which they were made and capable of withstanding the rigorous use to which they are subjected.

The disclosed embodiment is representative of a presently preferred form of the invention, but is intended to be illustrative rather than definitive thereof. The invention is defined in the claims.

What is claimed is:

1. A method of forming a four-sided container having a base from a pair of corresponding receptacles each of which has a bottom and four sides upstanding from the bottom, said method comprising removing a corresponding wall from each of said receptacles from a level corresponding to that of its bottom to convert each of said receptacles to a three-sided unit having a bottom; arranging the three-sided units in such position that their bottoms and two of their sides confront one another with form said four-sided container and said base; and securing the confronting bottoms and the confronting sides to one another thereby securing said units together.

2. The method according to claim 1 wherein said bottoms and side walls are secured to one another by introducing an uncured, curable adhesive between the confronting bottoms and the confronting side walls, and curing said adhesive in situ thereby bonding said units to one another.

3. The method according to claim 2 wherein said adhesive provides a bond between said confronting sides and said confronting bottoms, and fastening said confronting bottoms and sides together with anchor bolts prior to the introduction of said adhesive, thereby enabling said adhesive to bond to said anchor bolts.

* * * * *